US006529749B1

(12) United States Patent
Hayes et al.

(10) Patent No.: US 6,529,749 B1
(45) Date of Patent: Mar. 4, 2003

(54) CONVERTIBLE DIPOLE/INVERTED-F ANTENNAS AND WIRELESS COMMUNICATORS INCORPORATING THE SAME

(75) Inventors: Gerard James Hayes, Wake Forest, NC (US); Robert A. Sadler, Raleigh, NC (US)

(73) Assignee: Ericsson Inc., Research Triangle Park, NC (US)

( * ) Notice: Subject to any disclaimer, the term of this patent is extended or adjusted under 35 U.S.C. 154(b) by 0 days.

(21) Appl. No.: 09/575,838

(22) Filed: May 22, 2000

(51) Int. Cl.[7] ..... H01Q 1/48

(52) U.S. Cl. ..... 455/575; 455/78; 455/90; 455/269; 343/702; 343/846

(58) Field of Search ..... 455/78–83, 522, 455/553, 103, 132, 90, 269, 575; 343/724–730, 702, 835, 846, 780; 370/334

(56) References Cited

U.S. PATENT DOCUMENTS

| | | | | | |
|---|---|---|---|---|---|
| 5,420,599 | A | * | 5/1995 | Erkocevic | 343/702 |
| 5,926,139 | A | * | 7/1999 | Korisch | 343/700 MS |
| 5,926,150 | A | * | 7/1999 | McLean et al. | 343/700 MS |
| 6,006,117 | A | * | 12/1999 | Hageltorn et al. | 455/129 |
| 6,021,317 | A | * | 2/2000 | Irvin | 455/101 |
| 6,025,805 | A | * | 2/2000 | Smith et al. | 343/700 MS |
| 6,040,803 | A | * | 3/2000 | Spall | 343/700 MS |
| 6,166,694 | A | * | 12/2000 | Ying | 343/700 MS |
| 6,229,487 | B1 | * | 5/2001 | Sadler et al. | 343/700 MS |
| 6,268,831 | B1 | * | 7/2001 | Sanford | 343/700 MS |
| 6,326,921 | B1 | * | 12/2001 | Egorov et al. | 343/700 MS |

FOREIGN PATENT DOCUMENTS

| | | |
|---|---|---|
| EP | 0892459 | 1/1999 |
| GB | 2316540 A | 2/1998 |
| JP | 10-224142 | 8/1998 |
| JP | 11008512 | 12/1999 |

* cited by examiner

*Primary Examiner*—Thanh Cong Le
*Assistant Examiner*—Stephen D'Agosta
(74) *Attorney, Agent, or Firm*—Myers Bigel Sibley & Sajovec

(57) ABSTRACT

Multiple frequency band antennas having first and second conductive branches are provided for use within wireless communications devices, such as radiotelephones. First and second conductive branches are in adjacent, spaced-apart relationship. First and second signal feeds extend from the first conductive branch and terminate at respective first and second switches. Third and fourth signal feeds extend from the second conductive branch and terminate at respective third and fourth switches. The first and second conductive branches can jointly radiate as a dipole antenna in a first frequency band when the first and fourth switches are open, and when the second and third switches electrically connect the second and third feeds to a first receiver/transmitter. Antenna structure may be changed by reconfiguring the various switches. For example, the first and second conductive branches may radiate separately as respective inverted-F antennas, or may radiate independently as monopole antennas.

19 Claims, 7 Drawing Sheets

CONVERTIBLE DIPOLE/INVERTED-F ANTENNAS AND WIRELESS COMMUNICATORS INCORPORATING THE SAME

FIELD OF THE INVENTION

The present invention relates generally to antennas, and more particularly to antennas used with wireless communications devices.

BACKGROUND OF THE INVENTION

Radiotelephones generally refer to communications terminals which provide a wireless communications link to one or more other communications terminals. Radiotelephones may be used in a variety of different applications, including cellular telephone, land-mobile (e.g., police and fire departments), and satellite communications systems. Radiotelephones typically include an antenna for transmitting and/or receiving wireless communications signals. Historically, monopole and dipole antennas have been employed in various radiotelephone applications, due to their simplicity, wideband response, broad radiation pattern, and low cost.

However, radiotelephones and other wireless communications devices are undergoing miniaturization. Indeed, many contemporary radiotelephones are less than 11 centimeters in length. As a result, there is increasing interest in small antennas that can be utilized as internally-mounted antennas for radiotelephones.

In addition, it is becoming desirable for radiotelephones to be able to operate within multiple frequency bands in order to utilize more than one communications system. For example, GSM (Global System for Mobile) is a digital mobile telephone system that operates from 880 MHz to 960 MHz. DCS (Digital Communications System) is a digital mobile telephone system that operates from 1710 MHz to 1880 MHz. The frequency bands allocated for cellular AMPS (Advanced Mobile Phone Service) and D-AMPS (Digital Advanced Mobile Phone Service) in North America are 824–894 MHz and 1850–1990 MHz, respectively. Since there are two different frequency bands for these systems, radiotelephone service subscribers who travel over service areas employing different frequency bands may need two separate antennas unless a dual-frequency antenna is used.

In addition, radiotelephones may also incorporate Global Positioning System (GPS) technology and Bluetooth wireless technology. GPS is a constellation of spaced-apart satellites that orbit the Earth and make it possible for people with ground receivers to pinpoint their geographic location. Bluetooth technology provides a universal radio interface in the 2.45 GHz frequency band that enables portable electronic devices to connect and communicate wirelessly via short-range ad hoc networks. Accordingly, radiotelephones incorporating these technologies may require additional antennas tuned for the particular frequencies of GPS and Bluetooth.

Inverted-F antennas are designed to fit within the confines of radiotelephones, particularly radiotelephones undergoing miniaturization. As is well known to those having skill in the art, inverted-F antennas typically include a linear (i.e., straight) conductive element that is maintained in spaced apart relationship with a ground plane. Examples of inverted-F antennas are described in U.S. Pat. Nos. 5,684,492 and 5,434,579 which are incorporated herein by reference in their entirety.

Conventional inverted-F antennas, by design, resonate within a narrow frequency band, as compared with other types of antennas, such as helices, monopoles and dipoles. In addition, conventional inverted-F antennas are typically large. Lumped elements can be used to match a smaller non-resonant antenna to an RF circuit. Unfortunately, such an antenna may be narrow band and the lumped elements may introduce additional losses in the overall transmitted/received signal, may take up circuit board space, and may add to manufacturing costs.

Unfortunately, it may be unrealistic to incorporate multiple antennas within a radiotelephone for aesthetic reasons as well as for space-constraint reasons. In addition, some way of isolating multiple antennas operating simultaneously in close proximity within a radiotelephone may also be necessary. As such, a need exists for small, internal radiotelephone antennas that can operate within multiple frequency bands.

SUMMARY OF THE INVENTION

In view of the above discussion, the present invention can provide compact antennas that can radiate within multiple frequency bands for use within wireless communications devices, such as radiotelephones. An antenna according to an embodiment of the present invention may include first and second conductive branches in adjacent, spaced-apart, mirror-image relationship. The first conductive branch may include first and second signal feeds extending therefrom, and the second conductive branch may include third and fourth signal feeds extending therefrom.

The first and second signal feeds terminate at respective first and second switches, such as micro-electromechanical systems (MEMS) switches. The first switch is configured to selectively connect the first signal feed to a receiver and/or a transmitter that receives and/or transmits wireless communications signals, or to maintain the first signal feed in an open circuit (i.e., the first switch can be open). The second switch is configured to selectively connect the second signal feed to the same or a different receiver and/or transmitter, or to ground, or to maintain the second signal feed in an open circuit (i.e., the second switch can be open).

The third and fourth feeds terminate at respective third and fourth switches, such as MEMS switches. The third switch is configured to selectively connect the third feed to the same or a different receiver and/or transmitter, or to ground, or to maintain the third feed in an open circuit (i.e., the third switch can be open). The fourth switch is configured to selectively connect the fourth feed to the same or a different receiver and/or transmitter, or to maintain the fourth feed in an open circuit (i.e., the fourth switch can be open).

The first and second conductive branches can jointly radiate as a dipole antenna in a first frequency band when the first and fourth switches are open, and when the second and third switches electrically connect the second and third feeds to a first receiver. The first conductive branch can radiate as an inverted-F antenna in a second frequency band different from the first frequency band when the third and fourth switches are open, when the first switch is electrically connected to a second receiver, and when the second switch is electrically connected to ground. In addition, the first or second conductive branches can radiate independently as separate monopole antennas.

The first and second conductive branches can also radiate as separate inverted-F antennas in respective different frequency bands. For example, the first conductive branch can radiate as an inverted-F antenna when the first switch is electrically connected to a receiver, and when the second switch is electrically connected to ground. The second conductive branch can radiate as an inverted-F antenna when the third switch is electrically connected to ground, and when the fourth switch is electrically connected to a different receiver.

Antennas according to the present invention may be used with multiple receivers and/or transmitters, and multiple combinations of receivers and/or transmitters. Exemplary receivers and/or transmitters may include, but are not limited to, AMPS receivers/transmitters, PCS receivers/transmitters, GSM receivers/transmitters, DCS receivers/transmitters, GPS receivers, and Bluetooth receivers. For example, when the first and second conductive branches jointly radiate as a dipole antenna, the second and third switches may electrically connect the second and third feeds to a GSM transceiver. When the antenna structure is changed by reconfiguring the various switches as described above, the first and second conductive branches may be electrically connected to different receivers/transmitters. For example, the first conductive branch may radiate as an inverted-F antenna for a GPS receiver and the second conductive branch may radiate as an inverted-F antenna for a Bluetooth receiver.

According to additional embodiments of the present invention, portions (or all) of the first and second conductive branches may be disposed on or within one or more dielectric substrates. In addition, antennas according to the present invention may include first and second conductive branches with different configurations and with different effective electrical lengths.

Antennas according to the present invention may be particularly well suited for use within a variety of communications systems utilizing different frequency bands. Furthermore, because of their compact size, antennas according to the present invention may be easily incorporated within small communications devices. Furthermore, antennas according to the present invention may be well suited for use with receive-only applications such as GPS.

DETAILED DESCRIPTION OF THE INVENTION

Figure 1:
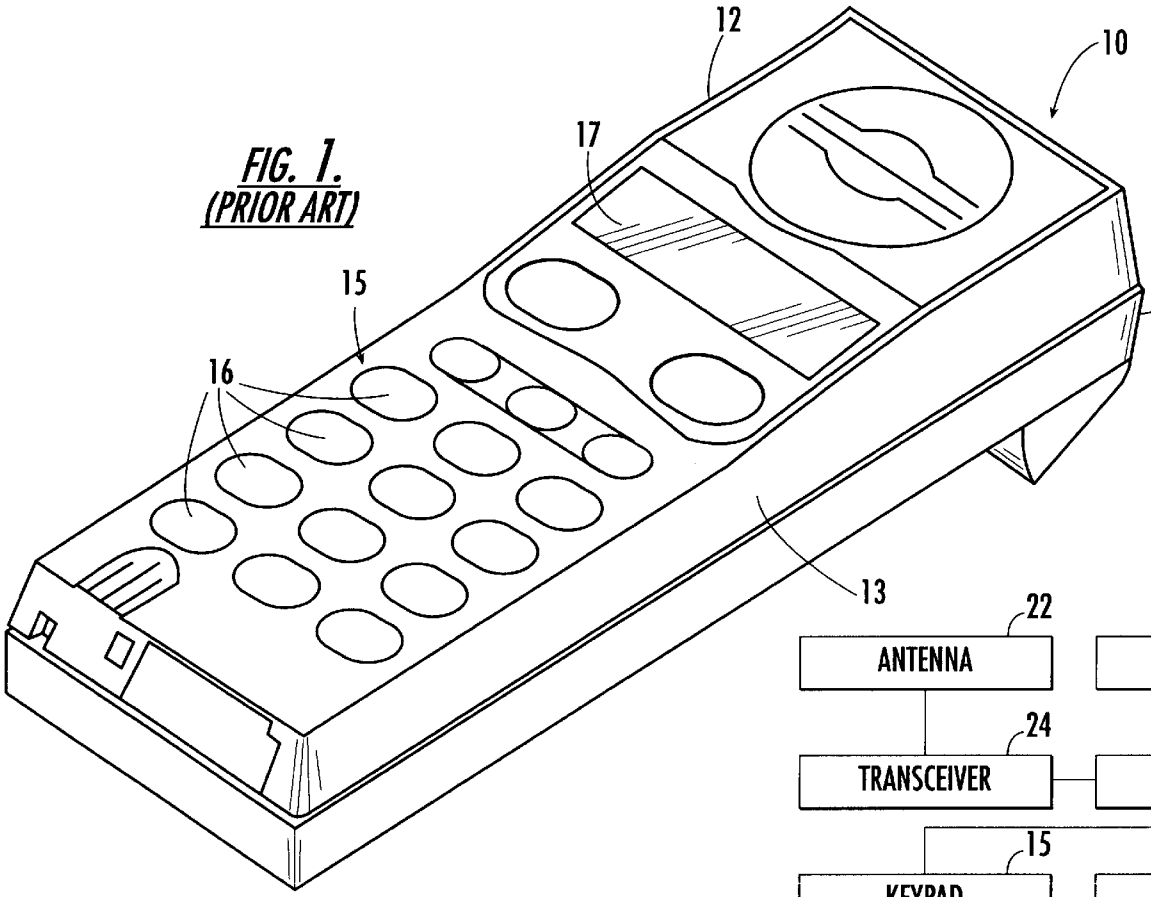
FIG. 1. (PRIOR ART)
FIG. 1 is a perspective view of an exemplary radiotelephone within which an antenna according to the present invention may be incorporated.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the. art. In the drawings, the thickness of layers and regions may be exaggerated for clarity. Like numbers refer to like elements throughout the description of the drawings. It will be understood that when an element such as a layer, region or substrate is referred to as being "on" another element, it can be directly on the other element or intervening elements may also be present. In contrast, when an element is referred to as being "directly on" another element, there are no intervening elements present.

Referring now to FIG. 1, a radiotelephone 10, within which antennas according to various embodiments of the present invention may be incorporated, is illustrated. The housing 12 of. the illustrated radiotelephone 10 includes a top portion 13 and a bottom portion 14 connected thereto to form a cavity therein. Top and bottom housing portions 13, 14 house a keypad 15 including a plurality of keys 16, a display 17, and electronic components (not shown) that enable the radiotelephone 10 to transmit and receive radiotelephone communications signals.

Figure 2:
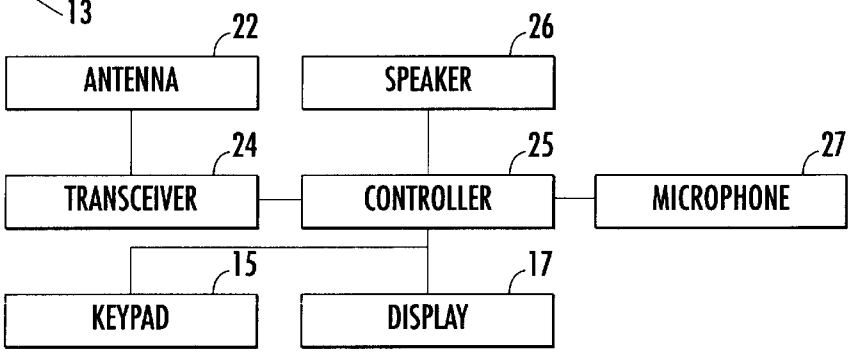
FIG. 2. (PRIOR ART)
FIG. 2 is a schematic illustration of a conventional arrangement of electronic components for enabling a radiotelephone to transmit and receive telecommunications signals.

A conventional arrangement of electronic components that enable a radiotelephone to transmit and receive radiotelephone communication signals is shown schematically in FIG. 2, and is understood by those skilled in the art of radiotelephone communications. An antenna 22 for receiving and transmitting radiotelephone communication signals is electrically connected to a radio-frequency transceiver 24 that is further electrically connected to a controller 25, such as a microprocessor. The controller 25 is electrically connected to a speaker 26 that transmits a remote signal from the controller 25 to a user of a radiotelephone. The controller 25 is also electrically connected to a microphone 27 that receives a voice signal from a user and transmits the voice signal through the controller 25 and transceiver 24 to a remote device. The controller 25 is electrically connected to a keypad 15 and display 17 that facilitate radiotelephone operation.

As is known to those skilled in the art of communications devices, an antenna is a device for transmitting and/or receiving electrical signals. A transmitting antenna typically includes a feed assembly that induces or illuminates an aperture or reflecting surface to radiate an electromagnetic field. A receiving antenna typically includes an aperture or surface focusing an incident radiation field to a collecting feed, producing an electronic signal proportional to the incident radiation. The amount of power radiated from or received by an antenna depends on its aperture area and is described in terms of gain.

Radiation patterns for antennas are often plotted using polar coordinates. Voltage Standing Wave Ratio (VSWR) relates to the impedance match of an antenna feed point with a feed line or transmission line of a communications device, such as a radiotelephone. To radiate radio frequency (RF) energy with minimum loss, or to pass along received RF energy to a radiotelephone receiver with minimum loss, the impedance of a radiotelephone antenna is conventionally matched to the impedance of a transmission line or feed point.

Conventional radiotelephones typically employ an antenna which is electrically connected to a transceiver operably associated with a signal processing circuit positioned on an internally disposed printed circuit board. In order to maximize power transfer between an antenna and a transceiver, the transceiver and the antenna are preferably interconnected such that their respective impedances are substantially "matched," i.e., electrically tuned to filter out or compensate for undesired antenna impedance components to provide a 50 Ohm (Ω) (or desired) impedance value at the feed point.

Figure 3:
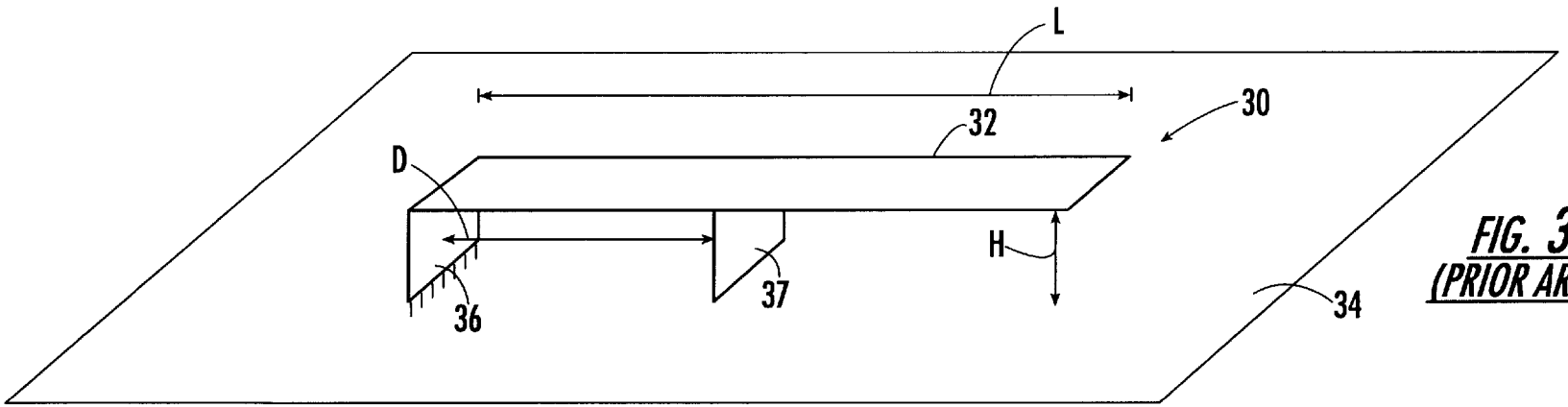
FIG. 3. (PRIOR ART)
FIG. 3 is a perspective view of a conventional planar inverted-F antenna.

Referring now to FIG. 3, a conventional planar inverted-F antenna is illustrated. The illustrated antenna 30 includes a linear conductive element 32 maintained in spaced apart relationship with a ground plane 34. Conventional inverted-F antennas, such as that illustrated in FIG. 3, derive their name from a resemblance to the letter "F." The illustrated conductive element 32 is grounded to the ground plane 34 as indicated by 36. A hot RF connection 37 extends from underlying RF circuitry through the ground plane 34 to the conductive element 32.

Figure 4A:
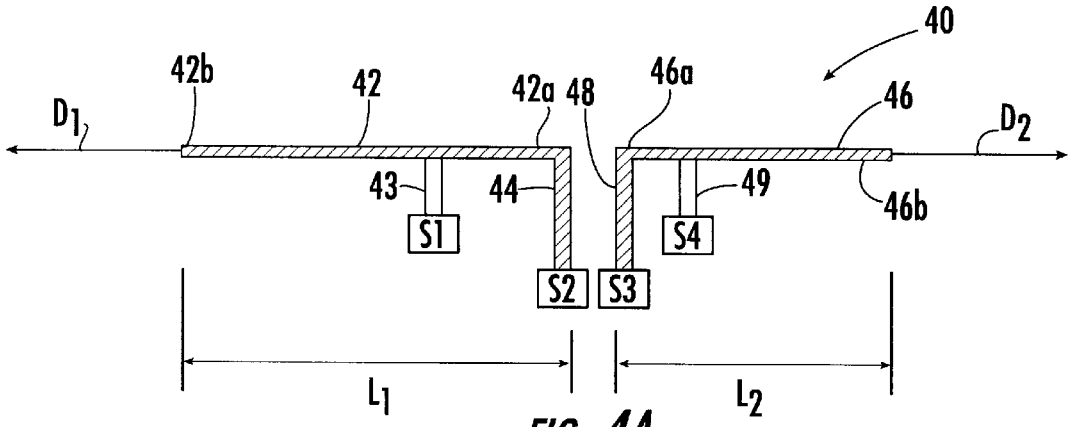
FIG. 4A schematically illustrates an antenna according to the present invention that is convertible between a dipole structure and either one or more inverted-F antenna structures or monopole structures.

Referring now to FIG. 4A, a multiple frequency band antenna 40 according to the present invention that is convertible between a dipole structure, one or more inverted-F structures, and independent monopole structures is illustrated. The illustrated antenna 40 includes a first conductive branch 42 having opposite first and second ends 42*a,* 42*b.* First and second feeds 43, 44 extend from the first conductive branch 42 adjacent the first end 42*a,* as illustrated. The first and second feeds 43, 44 terminate at respective first and second switches S1, S2.

A second conductive branch 46 is in adjacent, spaced-apart, mirror-image relationship with the first conductive branch 42, as illustrated. However, it is understood that the first and second conductive branches 42, 46 need not be in mirror-image relationship with each other. The first and second conductive branches 42, 46 may have various configurations relative to each other.

In the illustrated embodiment, the first conductive branch extends along a first direction $D_1$, and the second conductive branch extends along a second, opposite direction $D_2$. The first and second directions $D_1$, $D_2$ may be generally parallel, opposite directions. However, antennas according to the present invention may have first and second conductive branches that extend along respective directions that are not parallel.

The first conductive branch and the second conductive branch each have first and second electrical lengths $L_1$, $L_2$, respectively. The first and second electrical lengths may be the same or may be different. As would be understood by those of skill in the art, the first and second electrical lengths $L_1$, $L_2$ are tuning parameters of the antenna 40.

The second conductive branch 46 has opposite third and fourth ends 46*a,* 46*b.* The third end 46*a* is positioned adjacent the first end 42*a* of the first conductive branch 42, as illustrated. Third and fourth feeds 48, 49 extend from the second conductive branch 46 adjacent the second conductive branch third end 46*a,* as illustrated. The third and fourth feeds 48, 49 terminate at respective third and fourth switches S3, S4.

Preferably, the first, second, third, and fourth switches S1–S4 are micro-electromechanical systems (MEMS) switches. A MEMS switch is an integrated micro device that combines electrical and mechanical components fabricated using integrated circuit (IC) compatible batch-processing techniques and can range in size from micrometers to millimeters. MEMS devices in general, and MEMS switches in particular, are understood by those of skill in the art and need not be described further herein. Examples of MEMS switches are described in U.S. Pat. No. 5,909,078. It also will be understood that conventional switches, including relays and actuators, may be used.

The first switch S1 is configured to selectively connect the first feed 43 to either a receiver that receives wireless communications signals, or to maintain the first feed 43 in an open circuit (i.e., the first switch S1 can be open to electrically isolate the first feed 43). The second switch S2 is configured to selectively connect the second feed 44 to a receiver that receives wireless communications signals, or a transmitter that transmits wireless communications signals, or to ground, or to maintain the second feed 44 in an open circuit (i.e., the second switch S2 can be open to electrically isolate the second feed 44).

Although described herein with respect to receivers that receive wireless communications signals and transmitters that transmit wireless communications signals, it is understood that antennas according to the present invention may be utilized with transceivers that both transmit and receive wireless communications signals. Exemplary transceivers include radiotelephone transceivers that transmit and receive radiotelephone communications signals.

Still referring to FIG. 4A, the third switch S3 is configured to selectively connect the third feed 48 to a receiver that receives wireless communications signals, or to a transmitter that transmits wireless communications signals, or to ground, or to maintain the third feed 48 in an open circuit (i.e., the third switch S3 can be open to electrically isolate the third feed). The fourth switch S4 is configured to selectively connect the fourth feed 49 to a receiver that receives wireless communications signals, or to a transmitter that transmits wireless communications signals, or to maintain the fourth feed 49 in an open circuit (i.e., the fourth switch S4 can be open to electrically isolate the fourth feed).

Figure 4B:
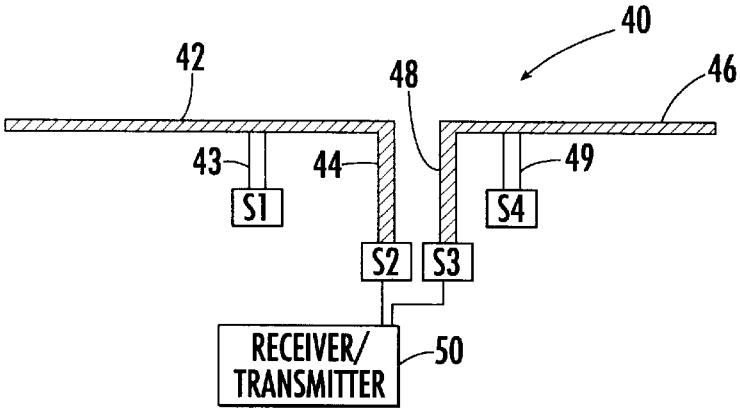
FIG. 4B illustrates the antenna of FIG. 4A wherein the first and fourth switches are open, and the second and third switches electrically connect the second and third feeds to a receiver such that the first and second conductive branches jointly radiate as a dipole antenna in a first frequency band.

The first and second conductive branches 42, 46 can jointly radiate as a dipole antenna in a first frequency band when the first and fourth switches S1, S4 are open, and when the second and third switches S2, S3 electrically connect the second and third feeds 44, 48 to a first receiver/transmitter 50 (FIG. 4B) . By selectively configuring the various switches S1–S4, the antenna 40 can be converted into different effective antenna structures that are operative within different frequency bands.

Figure 4C:
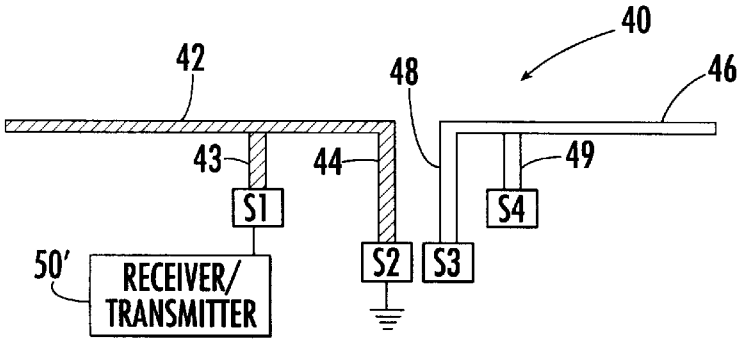
FIG. 4C illustrates the antenna of FIG. 4A wherein the third and fourth switches are open to electrically isolate the second conductive branch, the first switch is electrically connected to a second receiver, and the second switch is electrically connected to ground such that the first conductive branch can radiate as an inverted-F antenna in a second frequency band different from the first frequency band of the dipole antenna structure of FIG. 4B.

For example, the first conductive branch 42 can radiate as an inverted-F antenna in a second frequency band different from the first frequency band when the third and fourth switches S3, S4 are open to electrically isolate the second conductive branch 46, when the first switch S1 is electrically connected to a second receiver/transmitter 50', and when the second switch S2 is electrically connected to ground (FIG. 4C). For example, the first frequency band may be between about 900 MHz and 960 MHz and the second frequency band may be between about 1200 MHz and 1400 MHz. However, it is understood that antennas according to the present invention may radiate in various frequency bands. The second conductive branch 46 is indicated as electrically isolated in FIG. 4C by the absence of shading.

Figure 4D:
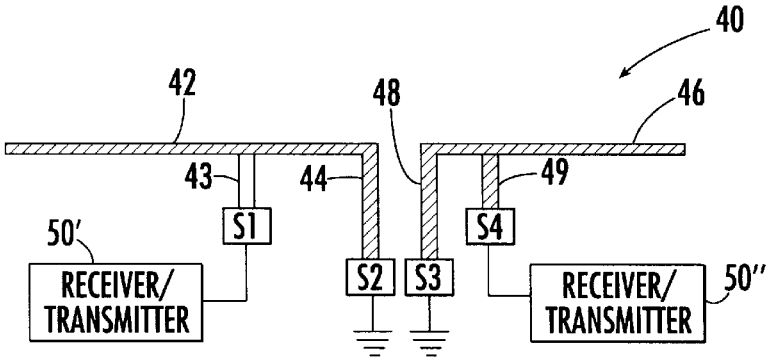
FIG. 4D illustrates the antenna of FIG. 4A wherein the first switch is electrically connected to a receiver, and the second switch is electrically connected to ground such that the first conductive branch can radiate as an inverted-F antenna in a second frequency band different from the first frequency band of the dipole antenna structure of FIG. 4B, and wherein the third switch is electrically connected to ground, and the fourth switch is electrically connected to a different receiver such that the second conductive branch can radiate as an inverted-F antenna in a third frequency band different from the first and second frequency bands.

As another example, the first conductive branch 42 can radiate as an inverted-F antenna in a second frequency band different from the first frequency band of the dipole antenna structure when the first switch S1 is electrically connected to a second receiver/transmitter 50', and when the second switch S2 is electrically connected to ground. In addition, the second conductive branch 46 can radiate as an inverted-F antenna in a third frequency band different from the first and second frequency bands when the third switch S3 is electrically connected to ground, and when the fourth switch S4 is electrically connected to a third receiver/transmitter 50" (FIG. 4D). For example, the first frequency band may be between about 900 MHz and 960 MHz, the second frequency band may be between about 1200 MHz and 1400 MHz and the third frequency band may be between about 2200 MHz and 2400 MHz. Again, it is understood that these are only exemplary frequency bands. Antennas according to this embodiment of the present invention may radiate in various different frequency bands.

As yet another example, the first or second conductive branches 42, 46 of the antenna 40 illustrated in FIG. 4A can independently radiate as respective monopole antennas.

Antennas according to the present invention may be used with multiple receivers and/or transmitters, and multiple combinations of receivers and/or transmitters. Exemplary receivers (and/or transmitters) include, but are not limited to, AMPS receivers/transmitters, PCS receivers/transmitters, GSM receivers/transmitters, DCS receivers/transmitters, GPS receivers, and Bluetooth receivers. For example, when the first and second conductive branches 42, 46 jointly radiate as a dipole antenna, the second and third switches S2, S3 may electrically connect the second and third feeds 44, 48 to a GSM transceiver. When the antenna structure is changed by reconfiguring the various switches S1–S4 as described above, the first and second conductive branches may be electrically connected to different receivers/transmitters. For example, the first conductive branch 42 may radiate as an inverted-F antenna for a GPS receiver and the second conductive branch 46 may radiate as an inverted-F antenna for a Bluetooth receiver.

Figure 5:
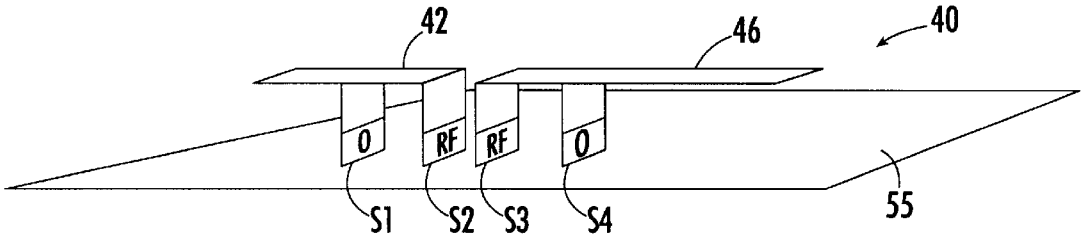
FIG. 5 schematically illustrates the antenna of FIG. 4A in an installed position within a wireless communications device, such as a radiotelephone.

Referring to FIG. 5, the antenna 40 of FIG. 4A is illustrated in an installed position within a wireless communications device, such as a radiotelephone (FIG. 1). The first and second conductive branches 42, 46 have rectangular configurations and are co-planar, as illustrated. The first end 42*a* of the first conductive branch 42 and the third end 46*a* of the second conductive branch are adjacent to each other and the respective free ends 42*b*, 46*b* extend away from each other in opposite directions $D_1$, $D_2$. The first and second conductive branches 42, 46 are maintained in adjacent, spaced-apart relationship with each other and with a ground plane 55, such as a printed circuit board (PCB) within a radiotelephone (or other wireless communications device), as illustrated. As would be understood by those of skill in the art, the first, second, third, and fourth switches S1, S2, S3, S4 are electrically connected to circuitry that allows each to be selectively connected to ground, or to a receiver/transmitter, or to an open circuit, as described above. In the illustrated embodiment, the first and fourth switches are open (indicated by O) and the second and third switches are electrically connected to a receiver/transmitter (indicated by RF) such that the first and second conductive branches 42, 46 radiate jointly as a dipole antenna.

Figure 6A:
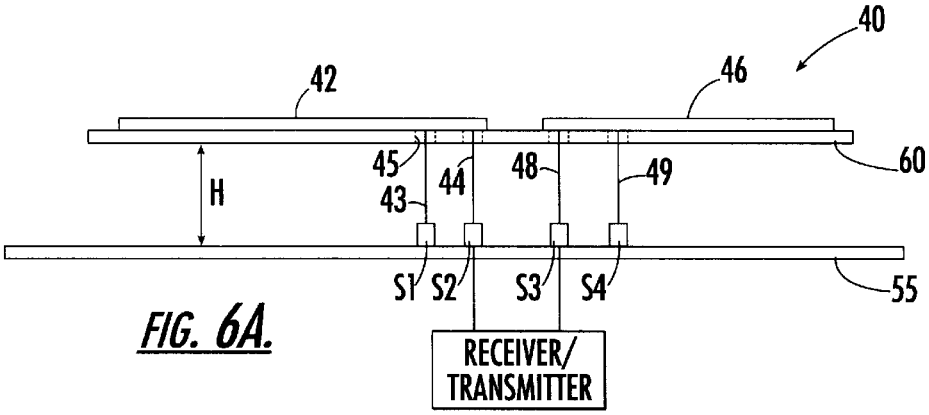
FIG. 6A is a side elevation view of a dielectric substrate having first and second conductive branches disposed thereon, according to another embodiment of the present invention, and wherein the dielectric substrate is in adjacent, overlying relationship with a ground plane.

According to another embodiment, illustrated in FIG. 6A, all or portions of the first and second conductive branches 42, 46 may be formed on a dielectric substrate 60, for example by etching a metal layer formed on the dielectric substrate. An exemplary material for use as a dielectric substrate 60 is FR4 or polyimide, which is well known to those having skill in the art of communications devices. However, various other dielectric materials also may be utilized. Preferably, the dielectric substrate 60 has a dielectric constant between about b andabout 4. However, it is to be understood that dielectric substrates having different dielectric constants may be utilized without departing from the spirit and intent of the present invention.

The antenna 40 of FIG. 6A is illustrated in an installed position within a wireless communications device, such as a radiotelephone. The dielectric substrate 60 having the first and second conductive branches 42 disposed thereon is maintained in an adjacent, spaced-apart relationship with a ground plane (PCB) 55. The first, second, third, and fourth feeds 43, 44, 48, 49 extend through respective apertures 45 in the dielectric substrate 60. The distance H between the dielectric substrate 60 and the ground plane 55 is preferably maintained at between about 2 mm and about 10 mm. However, the distance H may be greater than 10 mm and less than 2 mm.

Figure 6B:
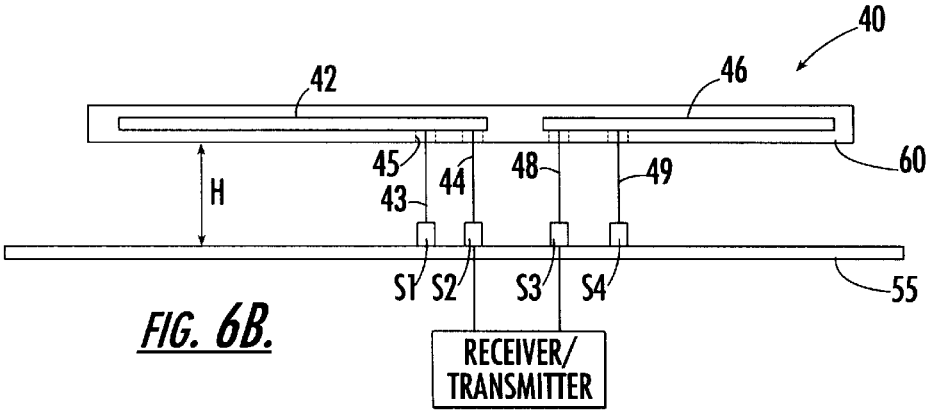
FIG. 6B is a side elevation view of a dielectric substrate having first and second conductive branches disposed therein, according to another embodiment of the present invention, and wherein the dielectric substrate is in adjacent, overlying relationship with a ground plane.

According to another embodiment of the present invention illustrated in FIG. 6B, all or portions of the first and second conductive branches 42, 46 may be disposed within a dielectric substrate 60.

A preferred conductive material out of which the first and second conductive branches 42, 46 of antennas according to the present invention may be formed is copper, typically 0.5 ounce (14 grams) copper. For example, the first and second conductive branches 42, 46 may be formed from copper foil. However, the first and second conductive branches 42, 46 according to the present invention may be formed from various conductive materials and are not limited to copper.

Figure 7A:
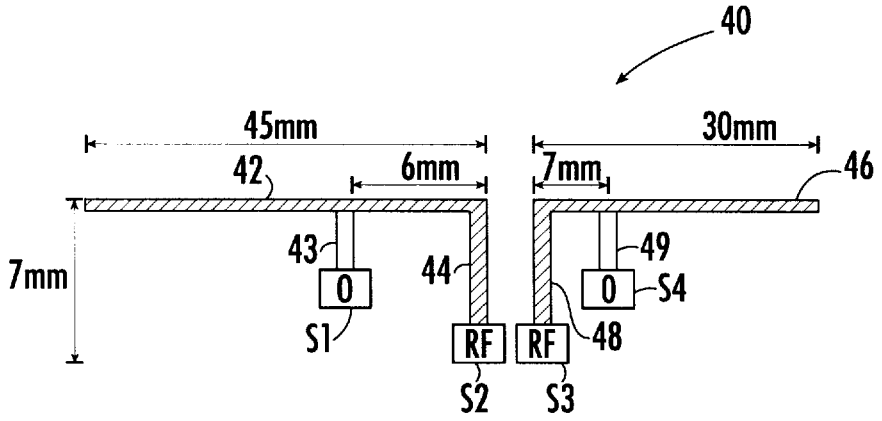
FIG. 7A schematically illustrates the antenna of FIG. 4A wherein the first switch is open, the second switch is connected to a receiver or transmitter, the third switch is connected to the receiver or transmitter, and the fourth switch is open.
Figure 7B:
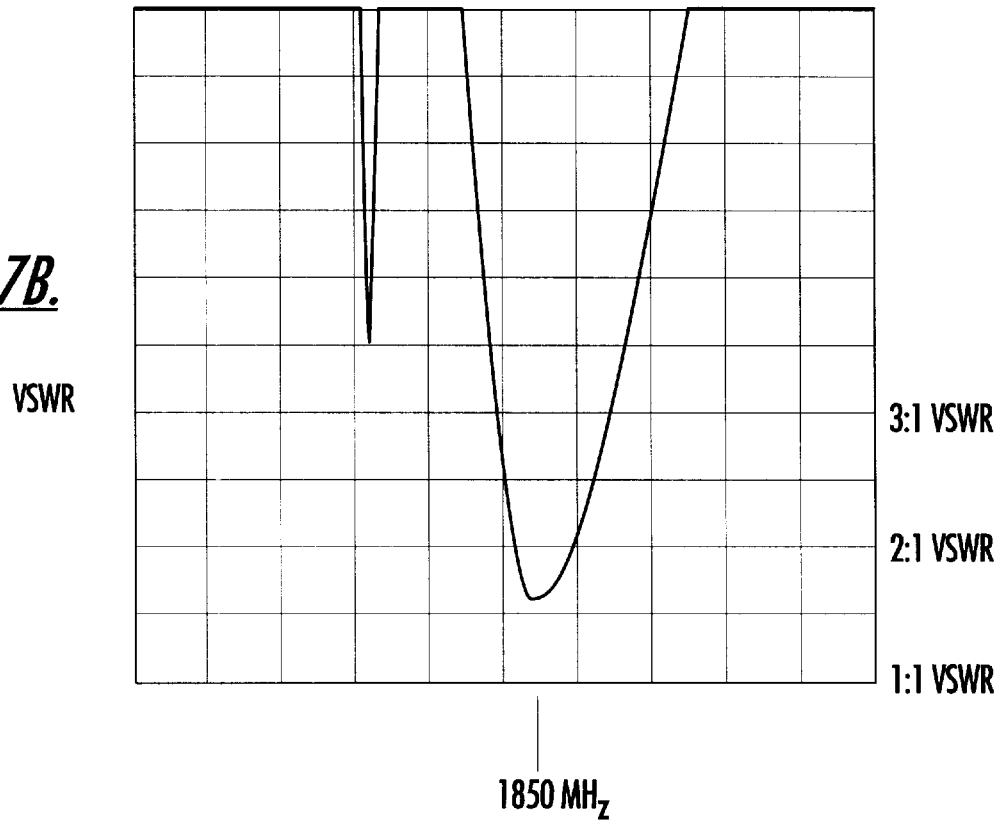
FIG. 7B is a graph of the VSWR performance of the antenna of FIG. 7A.

Referring now to FIGS. 7A–7B, the antenna 40 of FIG. 4A is illustrated with the first switch S1 open (indicated by O), the second switch S2 connected to a receiver or transmitter (indicated by RF), the third switch S3 connected to the receiver or transmitter (indicated by RF), and the fourth switch S4 open (indicated by O). With the switches in the illustrated configuration, the antenna 40 radiates as a dipole antenna in a frequency band centered around 1850 MHz, as illustrated in FIG. 7B. With the illustrated configurations of the switches S1–S4, the first and second conductive branches have effective electrical lengths of 45 mm and 30 mm, respectively. In the illustrated embodiment, the first and second feeds 43, 44 are spaced apart by a distance of 6 mm, and the third and fourth feeds 48, 49 are spaced apart by a distance of 7 mm. The first and second conductive branches 42, 46 are spaced apart from a ground plane (not shown) by a distance of 7 mm.

Figure 8A:
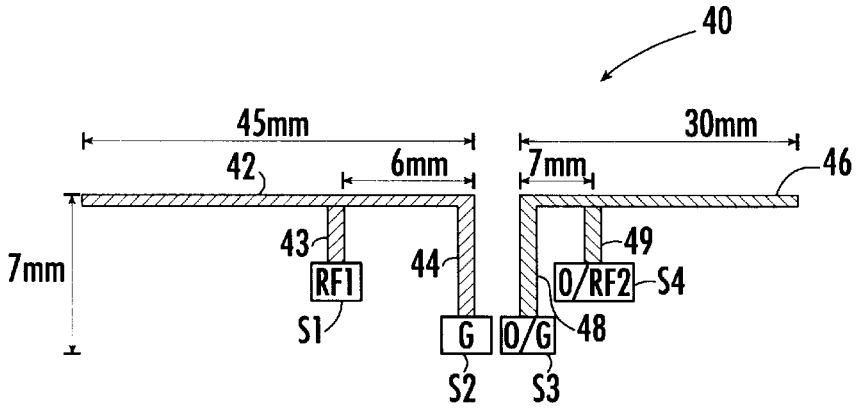
FIG. 8A schematically illustrates the antenna of FIG. 4A wherein the first switch is connected to a first receiver or a first transmitter, the second switch is connected to ground, the third switch is open or is connected to ground, and the fourth switch is open or is connected to a second receiver or a second transmitter.
Figure 8B:
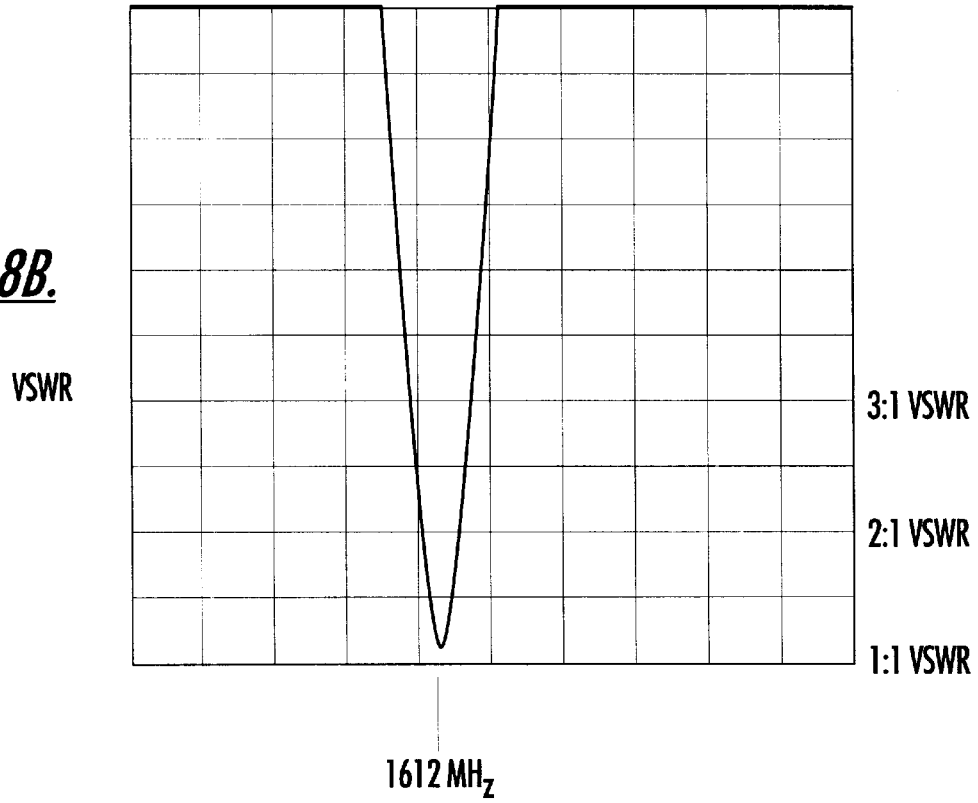
FIG. 8B is a graph of the VSWR performance of the antenna of FIG. 8A.

Referring now to FIGS. 8A–8B, the antenna 40 of FIG. 4A is illustrated with the first switch S1 connected to a first receiver or a first transmitter (indicated by RF1), the second switch S2 is connected to ground (indicated by G), the third switch S3 is open or is connected to ground (indicated by O/G), and the fourth switch S4 is open or is connected to a second receiver or a second transmitter (indicated by O/RF2). With the switches in the illustrated configuration, the antenna 40 radiates as an inverted-F antenna in a frequency band centered around 1612 MHz, as illustrated in FIG. 8B. With the illustrated configurations of the switches S1–S4, the first and second conductive branches have lengths of 45 mm and 30 mm, respectively. In the illustrated embodiment, the first and second feeds 43, 44 are spaced apart by a distance of 6 mm, and the third and fourth feeds 48, 49 are spaced apart by a distance of 7 mm. The first and second conductive branches 42, 46 are spaced apart from a ground plane (not shown) by a distance of 7 mm.

Figure 9A:
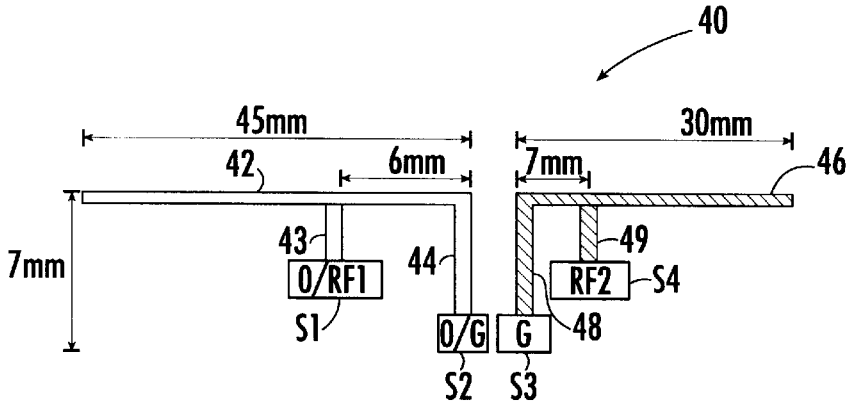
FIG. 9A schematically illustrates the antenna of FIG. 4A wherein the first switch is open or connected to a first receiver or a first transmitter, the second switch is open or is connected to ground, the third switch is connected to ground, and the fourth switch is connected to a second receiver or transmitter.
Figure 9B:
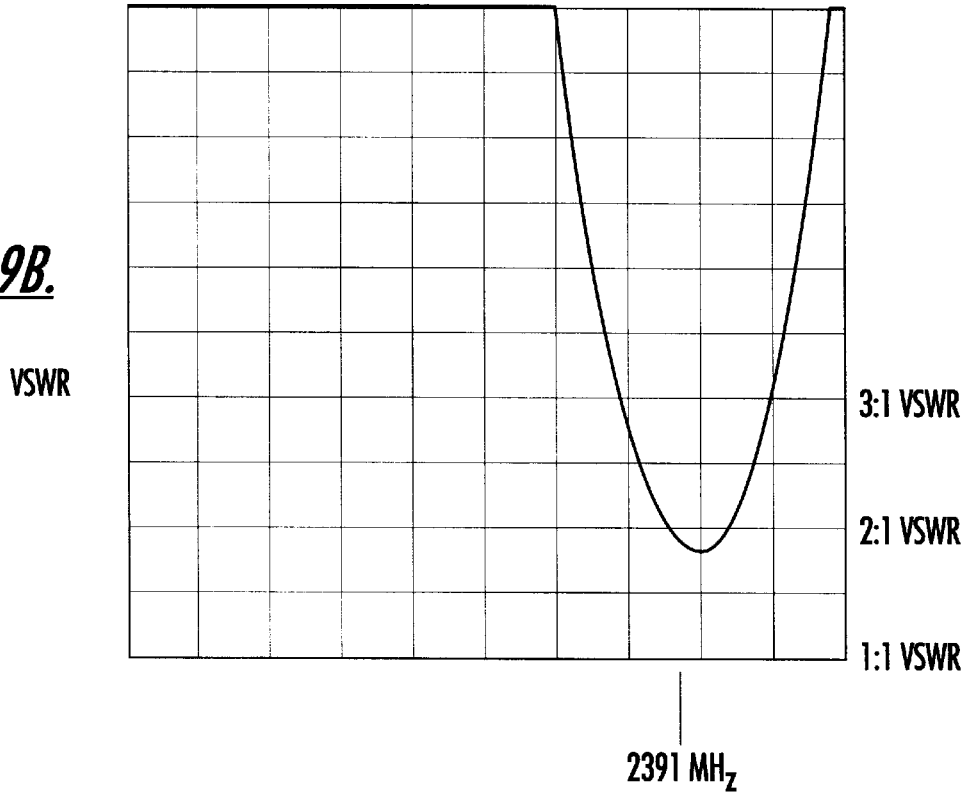
FIG. 9B is a graph of the VSWR performance of the antenna of FIG. 9A.

Referring now to FIGS. 9A–9B, the antenna 40 of FIG. 4A is illustrated with the first switch S1 open or connected to a first receiver or a first transmitter (indicated by O/RF1), the second switch S2 is open or is connected to ground (indicated by O/G), the third switch S3 is connected to ground (indicated by G), and the fourth switch S4 is connected to a second receiver or transmitter (indicated by RF2). With the switches in the illustrated configuration, the antenna 40 radiates as an inverted-F antenna in a frequency band centered around 2391 MHz, as illustrated in FIG. 9B. With the illustrated configurations of the switches S1–S4, the first and second conductive branches have lengths of 45 mm and 30 mm, respectively. In the illustrated embodiment, the first and second feeds 43, 44 are spaced apart by a distance of 6 mm, and the third and fourth feeds 48, 49 are spaced apart by a distance of 7 mm. The first and second conductive branches 42, 46 are spaced apart from a ground plane (not shown) by a distance of 7 mm.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A multiple frequency band antenna, comprising:

a first rectangular conductive branch having a first end and an opposite second free end;

first and second feeds extending from the first rectangular conductive branch adjacent the first rectangular conductive branch first end, wherein the first and second feeds terminate at respective first and second switches, wherein the first switch is configured to selectively connect the first feed to a receiver that receives wireless communications signals, or to a transmitter that transmits wireless communications signals, or to maintain the first feed in an open circuit, and wherein the second switch is configured to selectively connect the second feed to a receiver that receives wireless communications signals, or to a transmitter that transmits wireless communications signals, or to ground, or to maintain the second feed in an open circuit;

a second rectangular conductive branch in adjacent, spaced-apart relationship with the first rectangular conductive branch and having a third end and an opposite fourth free end, wherein the first end of the first rectangular conductive branch is in adjacent, spaced-apart relationship with the third end of the second rectangular conductive branch, and wherein the first and second rectangular conductive branches are co-planar, and wherein the second and fourth free ends extend away from each other in opposite directions; and third and fourth feeds extending from the second rectangular conductive branch adjacent the second rectangular conductive branch third end, wherein the third and fourth feeds terminate at respective third and fourth switches, wherein the third switch is configured to selectively connect the third feed to a receiver that receives wireless communications signals, or to a transmitter that transmits wireless communications signals, or to ground, or to maintain the third feed in an open circuit, and wherein the fourth switch is configured to selectively connect the fourth feed to a receiver that receives wireless communications signals, or to a transmitter that transmits wireless communications signals, or to maintain the fourth feed in an open circuit;

wherein the first and second rectangular conductive branches jointly radiate as a dipole antenna in a first frequency band when the first and fourth switches are open to electrically isolate the first and fourth feeds, respectively, and when the second and third switches electrically connect the second and third feeds to a first receiver or to a first transmitter; and wherein the first rectangular conductive branch radiates as an inverted-F antenna in a second frequency band different from the first frequency band, when the first switch is electrically connected to a second receiver or to a second transmitter, and when the second switch is electrically connected to ground.

2. (Amended) The antenna according to claim 1 wherein the first rectangular conductive branch radiates as an inverted-F antenna in a second frequency band different from the first frequency band when the first switch is electrically connected to a second receiver or to a second transmitter, and when the second switch is electrically connected to ground; and wherein the second rectangular conductive branch radiates as an inverted-F antenna in a third frequency band different from the first and second frequency bands when the third switch is electrically connected to the ground, and when the fourth switch is electrically connected to a third receiver or to a third transmitter.

3. The antenna according to claim 1 wherein the first or second rectangular conductive branches independently radiate as respective monopole antennas.

4. The antenna according to claim 1 wherein the first and second rectangular conductive branches have respective different electrical lengths.

5. The antenna according to claim 1 wherein the first receiver is selected from the group consisting of AMPS receivers, PCS receivers, GSM receivers, and DCS receivers, and wherein the second receiver is selected from the group consisting of GPS receivers and Bluetooth receivers.

6. The antenna according to claim 1 wherein the first and second rectangular conductive branches are in spaced-apart, mirror-image relationship.

7. The antenna according to claim 1 wherein the first, second, third, and fourth switches comprise micro-electromechanical system (MEMS) switches.

8. The antenna according to claim 1 wherein a portion of at least one of the first and second rectangular conductive branches is disposed on a respective surface of a dielectric substrate.

9. The antenna according to claim 1 wherein a portion of at least one of the first and second rectangular conductive branches is disposed within a dielectric substrate.

10. A wireless communicator, comprising:

a housing configured to enclose a receiver that receives wireless communications signals;

a ground plane disposed within the housing; and a multiple frequency band antenna, comprising:

a first rectangular conductive branch having a first end and an opposite second free end, wherein the first rectangular conductive branch is in adjacent, spaced-apart relationship with the ground plane;

first and second feeds extending from the first rectangular conductive branch adjacent the first rectangular conductive branch first end, wherein the first and second feeds terminate at respective first and second switches, wherein the first switch is configured to selectively connect the first feed to a receiver that receives wireless communications signals, or to a transmitter that transmits wireless communications signals, or to maintain the first feed in an open circuit, and wherein the second switch is configured to selectively connect the second feed to a receiver that receives wireless communications signals, or to a transmitter that transmits wireless communications signals, or to ground, or to maintain the second feed in an open circuit;

a second rectangular conductive branch in adjacent, spaced-apart relationship with the first rectangular conductive branch and having a third end and an opposite fourth free end, wherein the second rectangular conductive branch is in adjacent, spaced-apart relationship with the ground plane, wherein the first end of the first rectangular conductive branch is in adjacent, spaced-apart relationship with the third end of the second rectangular conductive branch, and wherein the first and second rectangular conductive branches are co-planar, and wherein the second and fourth free ends extend away from each other in opposite directions; and third and fourth feeds extending from the second rectangular conductive branch adjacent the second rectangular conductive branch third end, wherein the third and fourth feeds terminate at respective third and fourth switches, wherein the third switch is configured to selectively connect the third feed to a receiver that receives wireless communications signals, or to a transmitter that transmits wireless communications signals, or to ground, or to maintain the third feed in an open circuit, and wherein the fourth switch is configured to selectively connect the fourth feed to a receiver that receives wireless communications signals, or to a transmitter that transmits wireless communications signals, or to maintain the fourth feed in an open circuit;

wherein the first and second rectangular conductive branches jointly radiate as a dipole antenna in a first frequency band when the first and fourth switches are open to electrically isolate the first and fourth feeds, respectively, and when the second and third switches electrically connect the second and third feeds to a first receiver or to a first transmitter; and wherein the first rectangular conductive branch radiates as an inverted-F antenna in a second frequency band different from the first frequency band, when the first switch is electrically connected to a second receiver or to a second transmitter, and when the second switch is electrically connected to ground.

11. The wireless communicator according to claim 10 wherein the first rectangular conductive branch radiates as an inverted-F antenna in a second frequency band different from the first frequency band when the first switch is electrically connected to a second receiver or to a second transmitter, and when the second switch is electrically connected to ground; and wherein the second rectangular conductive branch radiates as an inverted-F antenna in a third frequency band different from the first and second frequency bands when the third switch is electrically connected to ground, and when the fourth switch is electrically connected to a third receiver or to a third transmitter.

12. The wireless communicator according to claim 10 wherein the first or second rectangular conductive branches independently radiate as monopole antennas.

13. The wireless communicator according to claim 10 wherein the first and second rectangular conductive branches have respective different electrical lengths.

14. The wireless communicator according to claim 10 wherein the first receiver is selected from the group consisting of AMPS receivers, PCS receivers, GSM receivers, and DCS receivers, and wherein the second receiver is selected from the group consisting of GPS receivers and Bluetooth receivers.

15. The wireless communicator according to claim 10 wherein the first and second rectangular conductive branches are in spaced-apart, mirror-image relationship.

16. The wireless communicator according to claim 10 wherein the first, second, third, and fourth switches comprises micro-electromechanical systems MEMS switches.

17. The wireless communicator according to claim 10 wherein a portion of at least one of the first and second rectangular conductive branches is disposed on a respective surface of a dielectric substrate.

18. The wireless communicator according to claim 10 wherein a portion of at least one of the first and second rectangular conductive branches is disposed within a dielectric substrate.

19. The wireless communicator according to claim 10 wherein the wireless communicator comprises a radiotelephone.

* * * * *